US005185631A

United States Patent [19]

Shibata

[11] Patent Number: 5,185,631

[45] Date of Patent: Feb. 9, 1993

[54] APPARATUS FOR UNIFORMLY SUPPLYING POWDER WITH REDUCED REMNANT POWDER

[75] Inventor: Kiyotaka Shibata, Takatsuki, Japan

[73] Assignee: Mita Industrial Co., Ltd., Osaka, Japan

[21] Appl. No.: 526,029

[22] Filed: May 21, 1990

[30] Foreign Application Priority Data

Jul. 18, 1989 [JP] Japan ..... 1-186536
Jul. 18, 1989 [JP] Japan ..... 1-186539

[51] Int. Cl.[5] ..... G03G 15/08; G03G 21/00

[52] U.S. Cl. ..... 355/245; 222/DIG. 1; 355/260

[58] Field of Search ..... 355/245, 260; 118/645; 222/DIG. 1

[56] References Cited

U.S. PATENT DOCUMENTS

| | | | |
|---|---|---|---|
| 4,360,944 | 11/1982 | Iwai et al. | 355/298 X |
| 4,422,750 | 12/1983 | Kawata | 355/245 X |
| 4,492,321 | 1/1985 | Zoltner | 222/DIG. 1 X |
| 4,650,097 | 3/1987 | Hagihara et al. | 355/260 X |
| 4,803,513 | 2/1989 | Nishise et al. | 355/260 X |
| 4,937,625 | 6/1990 | Kato et al. | 355/245 |
| 5,017,966 | 5/1991 | Suga | 355/260 |
| 5,030,998 | 7/1991 | Shibata et al. | 355/260 |

FOREIGN PATENT DOCUMENTS

| | | | |
|---|---|---|---|
| 60-179773 | 9/1985 | Japan | 355/298 |
| 62-21178 | 1/1987 | Japan | 355/260 |
| 63-123074 | 5/1988 | Japan | 355/260 |
| 1-292375 | 11/1989 | Japan | 355/260 |

*Primary Examiner*—Fred L. Braun
*Attorney, Agent, or Firm*—Beveridge, DeGrandi, Weilacher & Young

[57] ABSTRACT

An apparatus for supplying powder includes a container having sloping inner walls for containing powder, a transportation member rotatably disposed in the bottom portion of the container for transporting the powder in the predetermined direction, and a swing plate swung by the rotation of the transportation member. The upper end of the swing plate is fixed to one of the inner walls, and the bottom end is positioned in the locus of the transporation member. Another apparatus for supplying powder includes a container containing the powder and having a supply opening at the bottom to allow the powder to drop, a transportation member for transporting the powder in the container to the supply opening, and a rotation member closing the supply opening and by rotation allowing the powder to drop through the supply opening.

11 Claims, 10 Drawing Sheets

APPARATUS FOR UNIFORMLY SUPPLYING POWDER WITH REDUCED REMNANT POWDER

BACKGROUND OF THE INVENTION

The present invention relates to an apparatus for supplying powder. More particularly, the present invention relates to an apparatus for supplying stored powder to, for example, a transportation path.

The prior art will be described, wherein a toner hopper is used in the developing unit of a copying machine, for example.

The developing unit of a copying machine has a toner hopper (referred to as hopper below) for storing supply toner. As disclosed in U.S. Pat. No. 4,436,411, a hopper thereof usually has a bottom portion which is V-shaped in a sectional side view, formed by sloping inner surfaces. The stored toner moves down along the inner surfaces to the bottom portion. Then, as described in U.S. Pat. No. 4,803,513 and U.S. Pat. No. 4,422,750, the toner is transported further down, to the casing of the developing unit, by the rotation of a supply roller provided in the bottom part of the hopper.

With respect to the volume of the stored toner, a more moderate slope of the inner surfaces is preferred. This is due to the fact that a hopper having more gently sloping surfaces can contain a greater amount of toner. However, should the angles of the slopes be too reduced, toner in the hopper may not fall, wherein the toner would remain in the hopper and, furthermore, may deteriorate. At the same time, if the slopes of the hopper have too great an angle, the hopper can contain only a small amount of toner, though the toner does readily drop. Furthermore, the toner may form a bridge in a hopper having very steep slopes. The bridge causes a gap between the bulk of toner to be supplied and the supply roller, thereby interrupting the toner supply.

In order to improve the operation efficiency in exchanging the developing device, Japanese Patent Laying-Open No. 22367/1986 discloses a developing unit which comprises a developing device and a hopper separate from the developing device. This separable type developing unit must have transportation means in the hopper for transporting toner to a connection path between the hopper and the developing device. The transportation means usually consists of a rotatable member such as a spiral. Moreover, it may be presumed that if the rotating spiral agitates the toner, there would be little toner remnant in a hopper having moderate slopes inside for storing a greater amount of toner.

Such problems concerning the slope angles in a hopper, or problems concerning the contradiction with regard to the volume of stored powder as against remnant powder in the container, may occur not only in a toner hopper for use in the developing unit, but also in various other kinds of hoppers for storing other kinds of powder.

As briefly described in the above, a developing unit having a developing device and a hopper separate from the developing device to improve operation efficiency has been proposed. In this unit, the hopper may be designed for placement in a suitable position. However, wherein the hopper and the developing device are disposed far from each other, a long toner transportation path, such as a pipe, must be provided. Such a structure requires an opening in the bottom or a side of the hopper to supply toner to the transportation path.

However, if too large an amount of toner is supplied through the opening to the transportation path, an oversupply problem and/or a toner-spreading problem can occur. Furthermore, if the opening is formed in a side wall of the hopper, a bulk of the toner which is the farthest from the opening in the opposite side wall must be transported to the opening over some distance, so that the toner may become adhered to the inside wall of the hopper en route, due to its longer residence.

These problems may occur not only in toner supply apparatuses of copying machines but also in other kinds of powder supply apparatuses in which powder drops through an opening.

SUMMARY OF THE INVENTION

It is an object of the present invention to provide an apparatus for supplying powder, in which a large amount of powder can be stored wherein remnant powder is minimal.

It is another object of the present invention to provide an apparatus for supplying powder which comprises a simple structure to reduce remnant powder.

It is yet another object of the present invention to provide an apparatus for supplying powder wherein the powder supplied through an opening is always in the proper amount.

It is yet another object of the present invention to provide an apparatus for supplying powder as a toner-supplying apparatus whereby the problems of excess-toner and toner-scatter are solved.

(1) According to an aspect of the present invention, an apparatus for supplying powder comprises a container, a transportation member and a swing plate. The container has sloping inner walls and contains powder. The transportation member is placed rotatably at the bottom of the container, for transporting the powder in the predetermined direction. The swing plate is affixed to one of the sloping inner walls. The bottom end of the swing plate is positioned in the locus of the transporting member when the transportation rod rotates, whereby the swing plate is swung by the rotation of the transportation rod.

The transportation member may include a rod having a spiral thereon, and/or a rotor having a plurality of wings thereon.

According to this aspect, the powder contained in the container falls along the upper surface of the swing plate provided on the inner wall of the container. The powder in the bottom is transported by the transportation member in the predetermined direction. The rotation of the transportation member causes the swing plate to swing. Therefore, even if the slope of the inner surface of the container is moderate whereby the container may store a greater amount of powder, the powder readily drops to the bottom by the swinging of the plate. Accordingly, little powder is remnant in the container. (2) According to another aspect of the present invention, an apparatus for supplying powder comprises a container, a transportation member and a rotation member. The container is for containing powder and has a supply opening at the bottom to allow the powder to drop therethrough. The transportation member is for transporting the powder from the container to the supply opening. The rotation member is both for closing the supply opening and for allowing, by its rotation, the powder to drop through the supply opening.

According to this aspect, the powder in the container is transported to the supply opening located in the bottom of the container. Since the supply opening is formed in the bottom of the container, the transportation length of the powder is thereby shorter than that of a conventional container having a supply opening in the side wall, whereby little powder is remnant in the end of the container, and whereby little adheres to it.

The supply opening of the container is covered by the rotation member, and moreover the rotation of the rotation member supplies the powder. Therefore, excess powder cannot fall through the supply opening, and a proper amount of powder is supplied to the transportation path through the supply opening by the rotation member.

These and other objects and advantages of the present invention will be more fully apparent from the following detailed description.

DESCRIPTION OF THE PREFERRED EMBODIMENT

Outline of Copying Machine Structure

Figure 1:
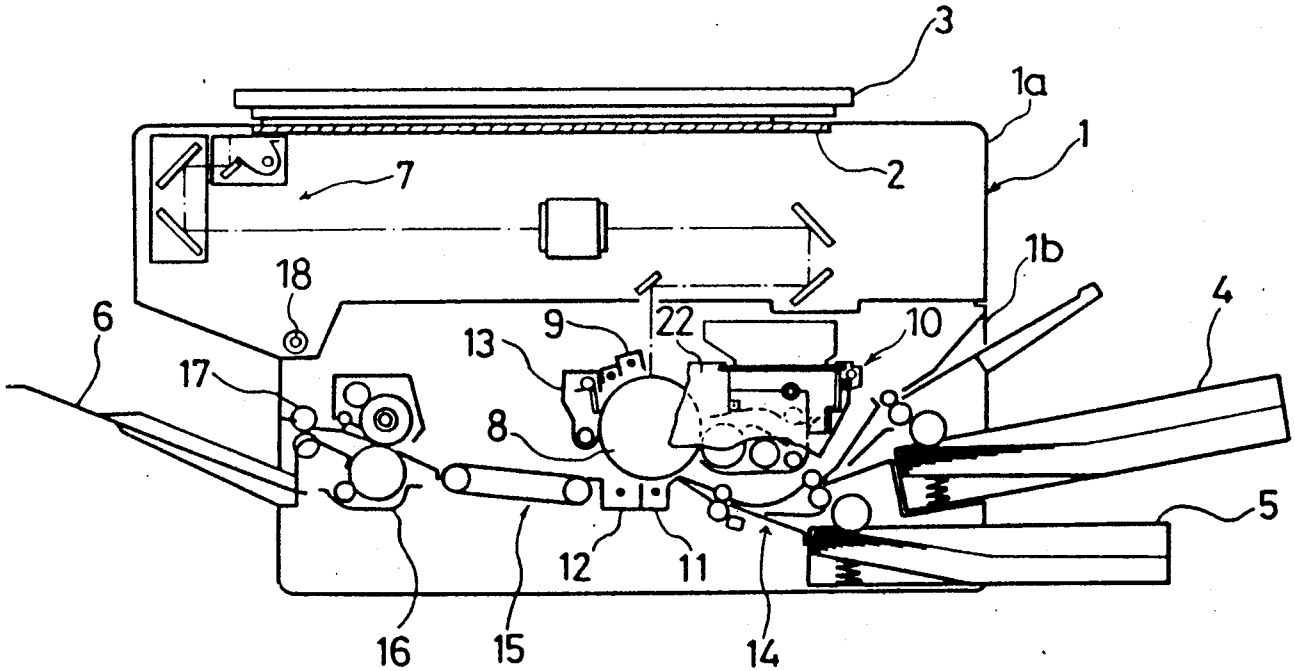
FIG. 1 is a sectional, schematic view showing a copying machine having a hopper according to the present invention.

FIG. 1 shows the outline of the structure of an electrostatic-process copying machine having a toner hopper as an apparatus for supplying powder in accordance with an embodiment of the present invention.

A machine body 1 consists of the upper portion 1*a* and the lower portion 1*b*. The upper portion 1*a* can pivot on a hinge 18 at the left side of the figure to open the machine body 1. The machine body 1 has a contact glass 2 in the upper surface and an original holder 3 thereon which can be opened. On the right side of the machine body in the figure, detachable paper cassette cases 4 and 5 are attached. On the left side of the machine body 1, a copy tray 6 is attached wherein copied paper is received.

In the machine body 1, an optical exposure system 7 for obtaining information from the original image is located in the upper portion 1*a*. The exposure system 7 consists of a light source, mirrors and lenses. Disposed, as a photoconductor, in the central part of the lower portion 1*b* is a photoconductive drum 8, as a photoconductor, on which an electrostatic image is formed. Surrounding the photoconductive drum 8, there is an image forming part which consists of a corona-generating device 9 for charging the photoconductive drum 8 with a predetermined level of electric charge, a developing unit 10 for developing an electrostatic image, a transfer unit 11 for transferring a toner image to paper, a detach unit 12 for detaching paper from the photoconductive drum 8, and a cleaning unit 13 for removing toner from the photoconductive drum 8, in that order. A paper transferring path 14 is provided between the paper cassette cases 4 and 5 and the image forming part. In a part of the paper stream lower than the image forming part, a paper transportation device 15 is provided. A fixing unit 16 for fixing a transferred image on the fed paper is disposed between the paper transferring device 15 and the copy tray 6. Beyond the fixing unit 16 in the paper flow, a pair of rollers 17 are provided for disposing of paper to the copy tray 6.

Outline of Structure of Developing Unit

Figure 2:
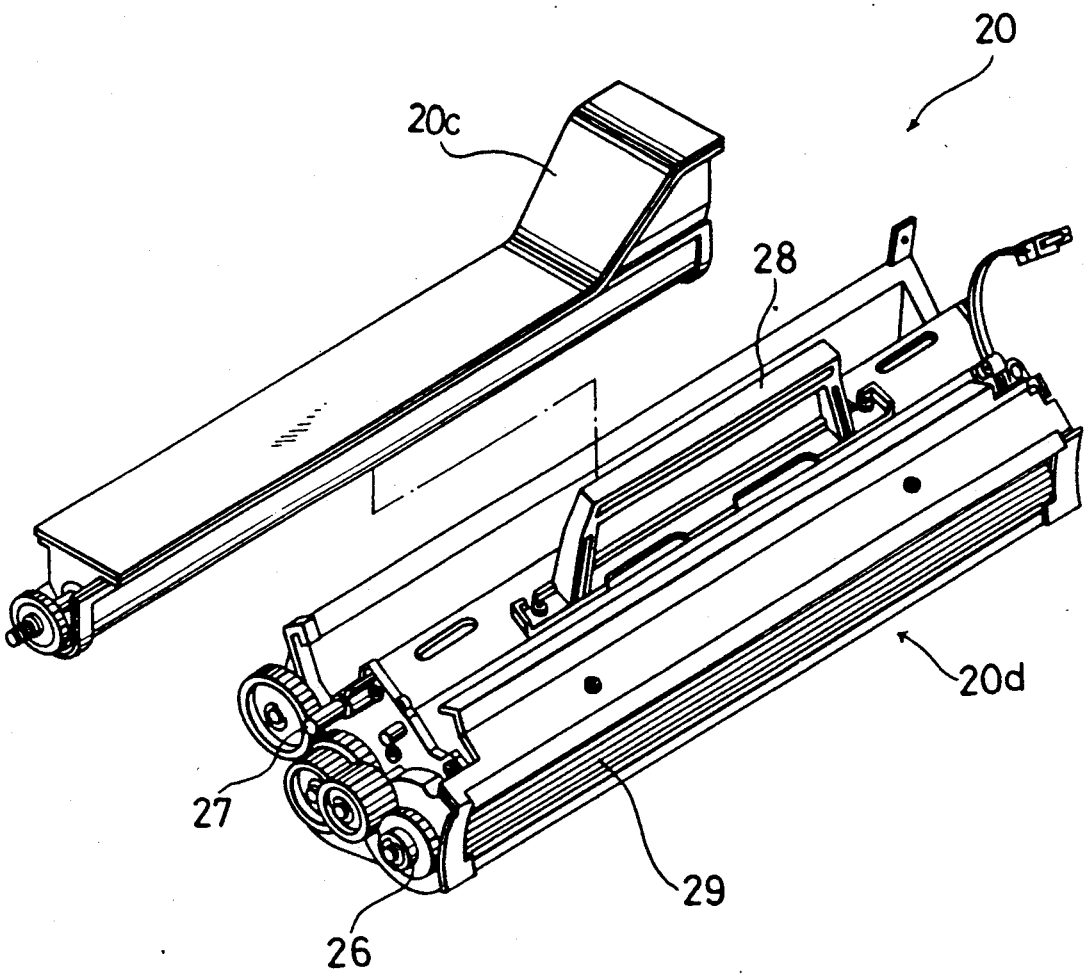
FIG. 2, an isometric view, and FIG. 3, a sectional view, are views showing decomposed parts of a developing unit of the copying machine.
Figure 3:
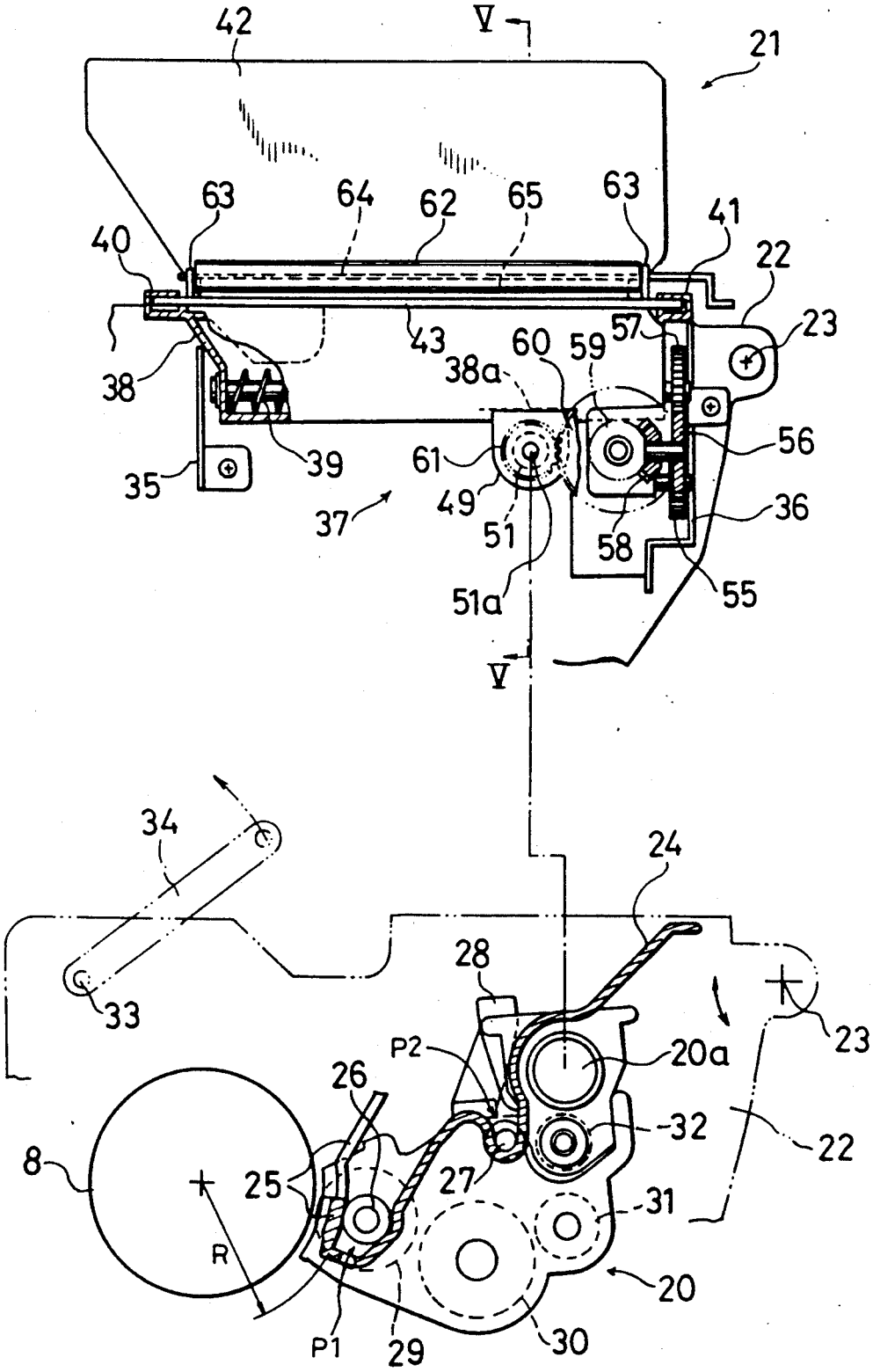

Referring to FIG. 3, the developing unit 10 consists mainly of a developing device 20 and a hopper 21 for supplying toner to the developing device 20. The developing device 20 consists of a body 20*d* and a supply part 20*c* on the body 20*d* (shown in FIG. 2). The developing device 20 is placed between a front plate 22 and a back plate (not shown), where the side of the copying machine closer to an operator is referred to as the front side and the side opposite is referred to as the back side. The developing device 20 is slidable in the direction perpendicular to the axis of the photoconductive drum 8, or upward in this embodiment, to be attached and detached. The front plate 22 located at the front in the lower part 1*b* is pivotable upward, or clockwise, on a fulcrum 23, from the position shown in FIG. 3. The back plate, located at the back in the lower portion 1*b*, is pivotable in the same manner as the front plate 22.

Figure 4:
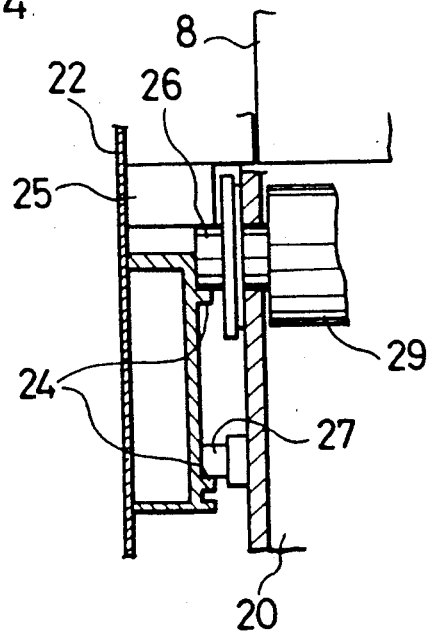
FIG. 4 is a sectional, partial view of a fixing part of the developing unit.

Referring to FIGS. 3 and 4, guides 24 and 25 for guiding the developing device 20 to the predetermined position are formed on the inside of the front plate 22 and of the back plate. Meanwhile, the developing device 20 has support members 26 and 27 on its side walls which project into the guides 24 and 25. The support members 26 and 27 are supported by a first pocket P1 and a second pocket P2 formed by the guides 24 and 25.

In the first pocket P1, an inside surface of the guide 25 supporting the support member 26 of the developing device 20 comprises a part of an arc of radius R whereof the center coincides with the axis of the photoconductive drum 8. In addition, a handle 28 is attached to the upper part of the developing device 20 in order to draw up the developing device 20.

Structure of Developing Device

Figure 5:
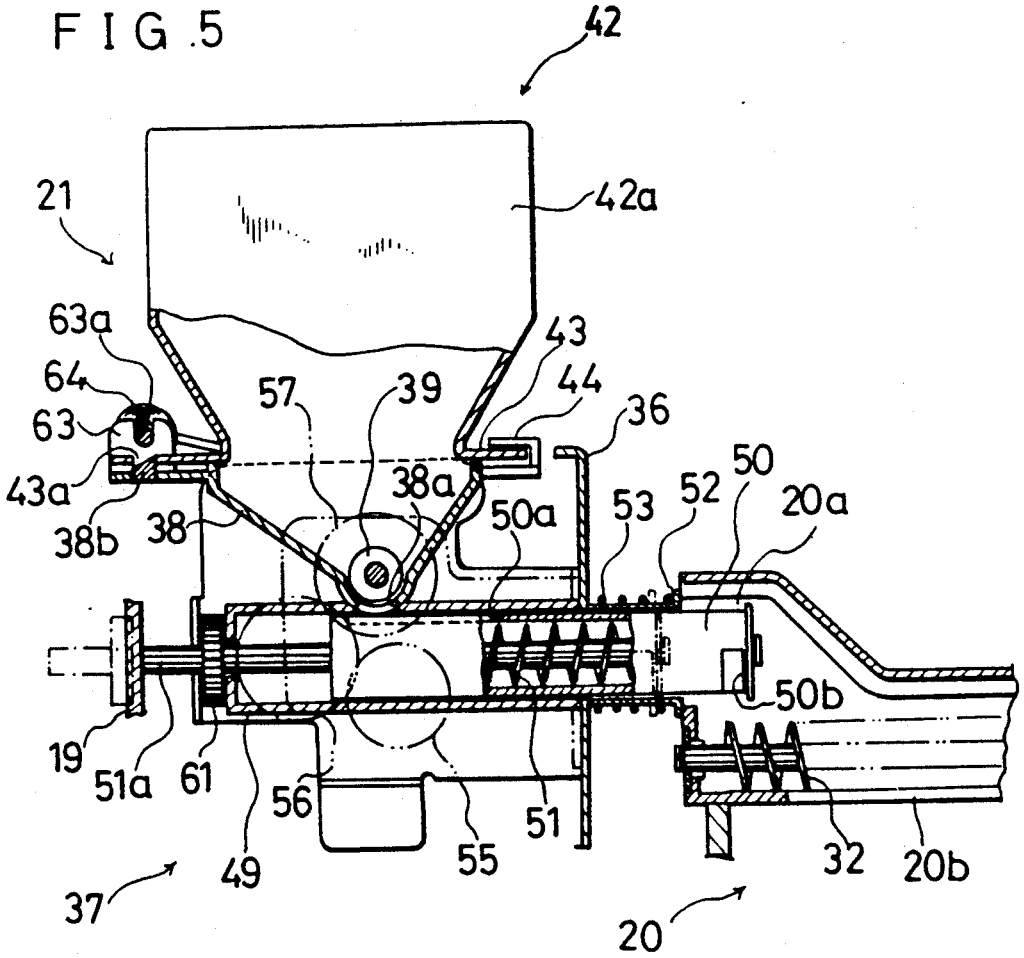
FIG. 5 is a sectional view taken along the line V—V of FIG. 3.
Figure 6:
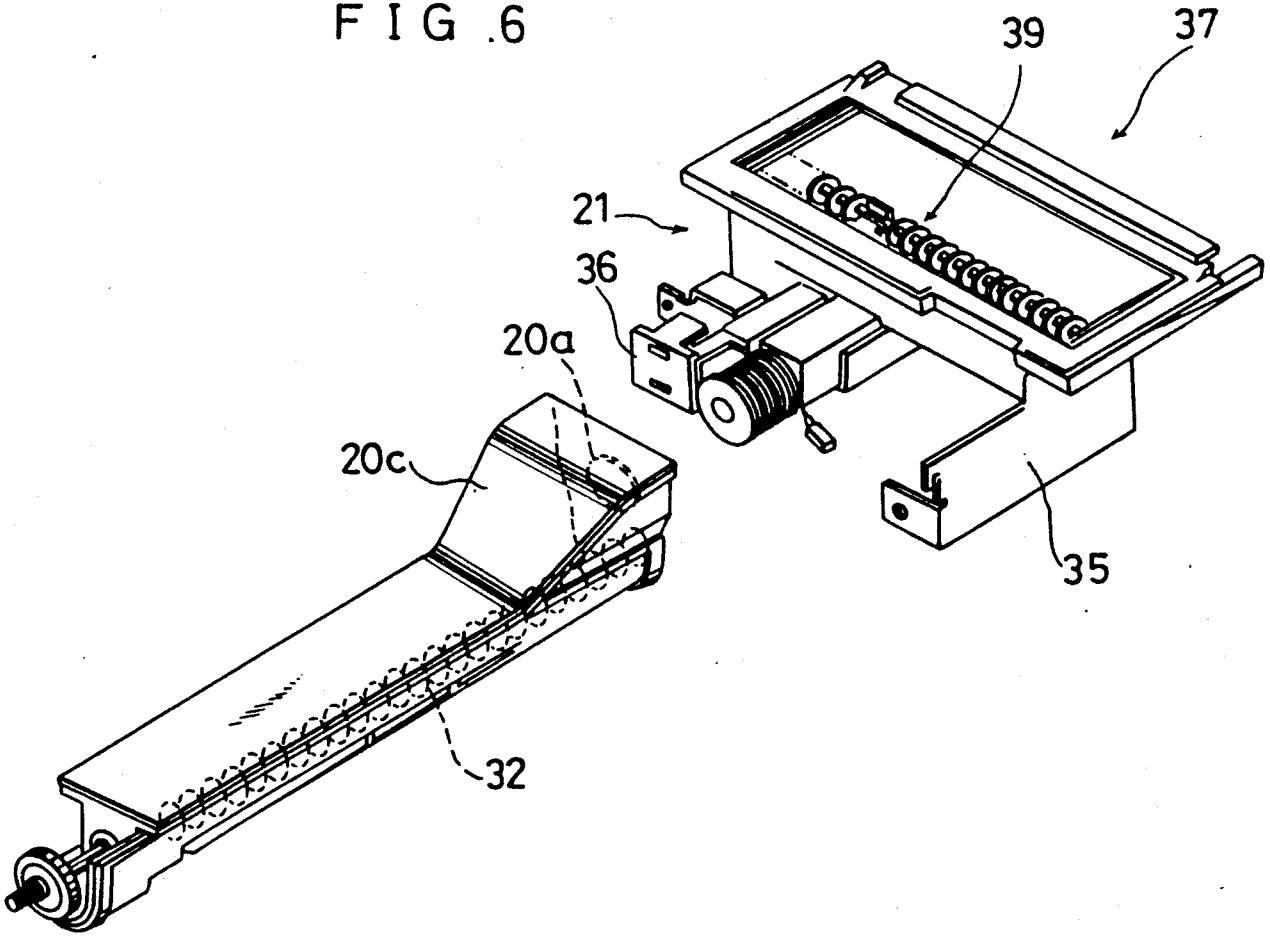
FIGS. 6 and 7 are isometric views showing toner transporting paths between a hopper and a developing device.

Similarly to the conventional developing device, the developing device 20 has in its body 20*d* a developing roller 29 for supplying toner to the photoconductive drum 8, a scooping rotor 30 for scooping developer consisting of toner and carrier to the developing roller 29, and an agitation roller 31 for agitating the developer in the developing device 20, all of which are rotatable. Above the agitation roller 31, a spiral 32, shown in FIGS. 5 and 6, is rotatably provided for transferring toner supplied from the hopper 21, described below, in the lateral direction of the developing device 20. Furthermore, an opening 20*a* connected to the hopper 21 is formed in the front wall of the supply part 20*c* above the spiral 32, as shown in FIGS. 5 and 6. A link member 34 is pivotally connected with a pin 33 to the upper part of the left end, in FIG. 3, of the front plate 22 which supports the developing device 20 and the photoconductive drum 8. The upper end of the link member 34 is pivotally connected to the upper portion 1*a* of the copying machine body 1.

Structure of Hopper

Referring to FIGS. 3, 5 and 6: the hopper 21 is disposed in the front of the developing device 20 and fixed to the front plate 22 with supporting plates 35 and 36. The hopper 21 consists mainly of a hopper body 37 and a cartridge 42.

Hopper Body

The hopper body 37 has a toner container 38 for containing toner. The toner container 38 has a pair of inside walls at both ends in the widthwise direction, which slope to make a "V", as in the sectional side view, and another pair of inside walls at both ends in the direction perpendicular to the widthwise direction, which slope as well. Accordingly the container 38 opens out at its upper end. The toner container 38 has holders 40 and 41, whereof the sectional shape is similar to a "C", at the upper left and right ends. The holders 40 and 41 hold a flange 43 surrounding the opening of the toner cartridge 42, as described below. Referring to FIG. 5: another holder 44 is formed in the rear portion of the toner container 38. The holder 44 holds the flange 43 of the toner cartridge 42 similarly by the holders 40 and 41.

Referring to FIGS. 5, 7, 8 and 10: a toner supply opening 38*a* for allowing toner to drop is formed at the bottom of the toner container 38. The toner supply opening 38*a* is formed slightly on the right (in FIG. 3) of the middle in the lengthwise direction of the toner container 38 to correspond to the connecting opening 20*a* of the developing device 20, as in the view in FIG. 3. In the bottom portion of the toner container 38, a transfer means 39 is disposed to transfer the toner in the container 38 to the opening 38*a*. The transfer means 39 consists of a rod 39*d* and a transfer member. The transfer member consists of a rotor 39*a* having four wings 45, above the toner supply opening 38*a*, and a pair of spirals 39*b* and 39*c* on either side of the rotor 39*a* and opposite to each other in terms of twisting direction, for transferring the toner to the rotor 39*a*.

Figure 9:
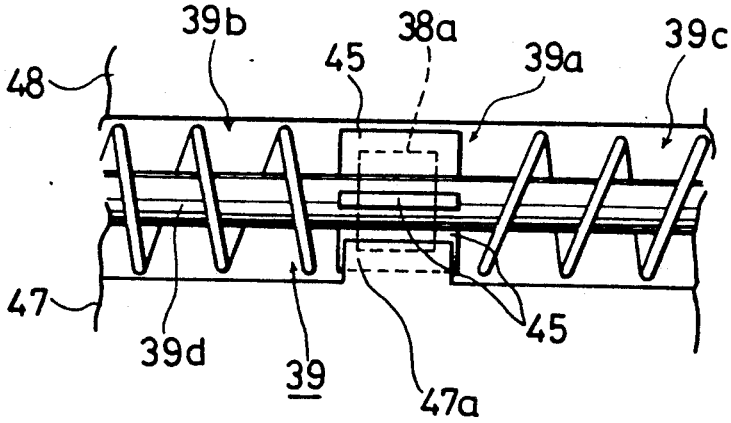
FIG. 9 is a plan view showing a part of a toner container.
Figure 10:
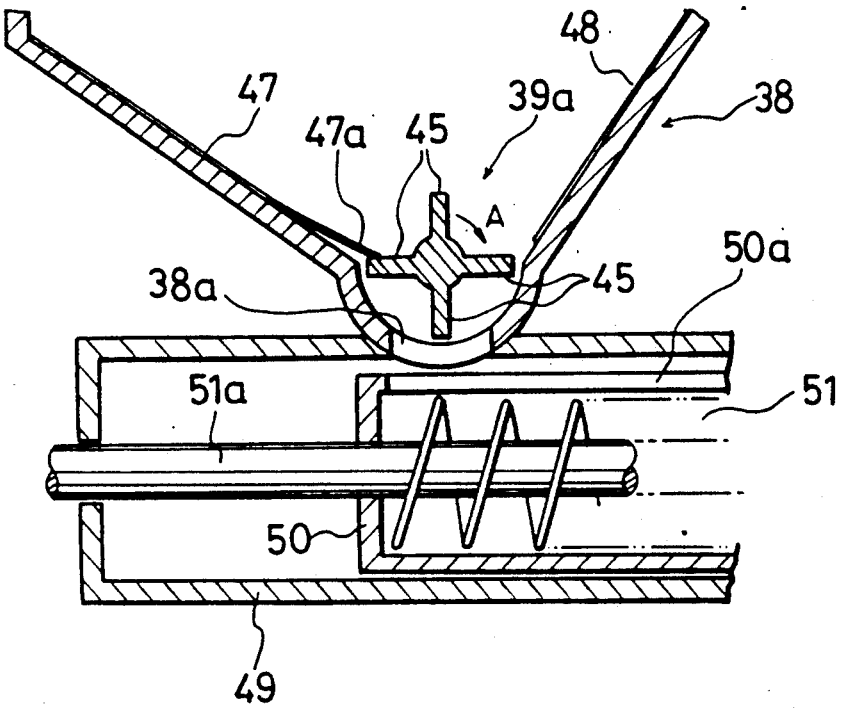
FIG. 10 is a vertically sectional view showing the bottom part of the container.

The rotor 39*a*, as shown in FIGS. 9 and 10, covers the toner supply opening 38*a* with its wings 45 whereby an excessive amount of toner cannot be supplied at a given time.

Figure 8:
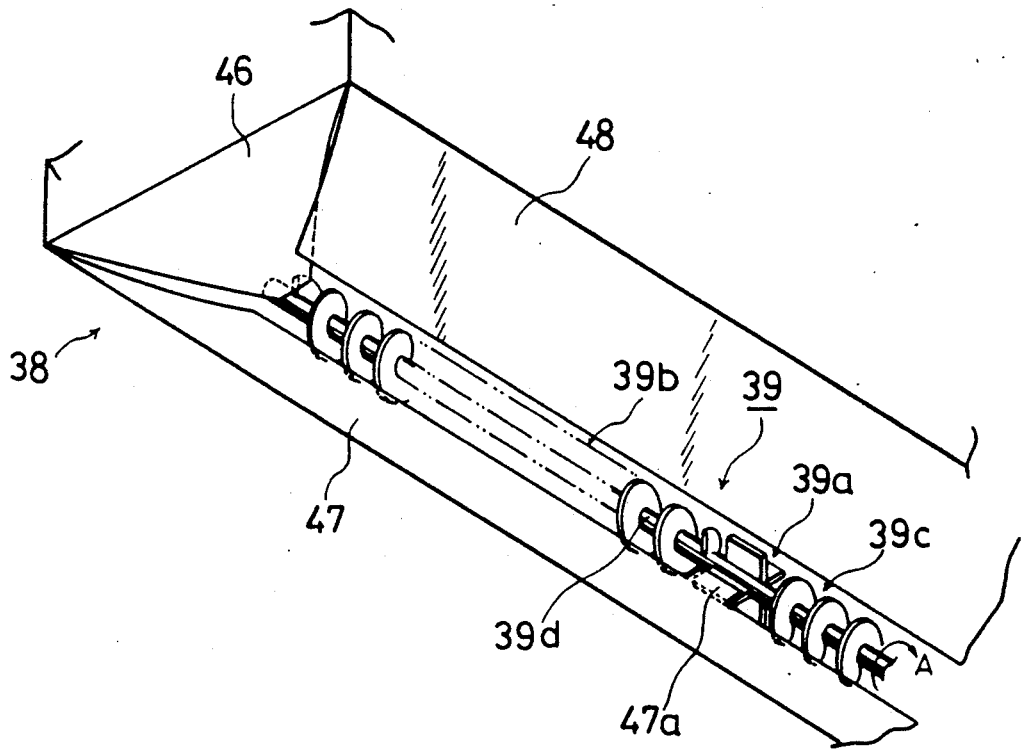
FIG. 8 is an isometric view showing the inside of a toner container.

Referring to FIG. 8: placed on a pair of sloping walls of the toner container 38 are side swing plate 46 (one of which is shown in FIG. 8), a front swing plate 47 and a rear swing plate 48 (as an auxiliary swing plate), made of elastic material such as polyester film. Each swing plate 46 is attached to the inside surface of the container 38 at its upper portion, leaving its lower portion free. Each bottom end of the side swing plates 46 is on an end of the spiral 39*b* and 39*c*. The bottoms of the side portions of the rear swing plate 48 are placed on the side swing plates 46 so that the rear swing plate 48 is swung by the oscillation of the side swing plates 46.

Part of the bottom portion of the front swing plate 47 has a projection 47*a*. The projection 47*a* is placed on the wing 45 adjacent to the front swing plate 47, as shown in FIGS. 8–10. The direction of the rotation of the transfer means 39 as shown with an arrow A in FIGS. 8 and 10 is predetermined whereby the projection 47*a* cannot be bent down towards the opening 38*a*.

Referring to FIGS. 3 and 5: a cylindrical casing 49 provided below the toner container 38 extends in the direction perpendicular to the transfer member 39. In the cylindrical casing 49, a toner supply pipe 50 is slidably inserted. An upper opening 50*a* is formed in the upper portion of the toner supply pipe 50. The opening 50*a* always connects the inside of the pipe 50 and the toner supply opening 38*a* of the toner container 38, regardless of where the toner supply pipe 50 is located within its range of sliding. A lower opening 50*b* is formed circumferentially in the lower half of the pipe 50, (at the right end in FIG. 5). A spiral 51 is provided rotatably in the pipe 50, whereby toner dropped from the toner container 38 is transported to the end of the toner supply pipe 50. A rod 51*a* of the spiral 51 protrudes from the hopper 21 through the end of the operator side (or the left side in FIG. 5) of the toner supply pipe 50 and the end of the cylindrical casing 49. Referring to FIG. 5: when the front cover 19 of the machine body 1 is closed, the front cover 19 pushes the end of the rod 51*a* with its inner surface. Accordingly, the toner supply pipe 50 is pushed into the machine body 1, and the other end of the pipe 50 moves into the opening 20*a* of the developing device 20.

In order to close the lower opening 50*b* of the pipe 50, a cover 52 slidably fits onto the tip-end portion of the toner supply pipe 50. The cover 52 can move along the toner supply pipe 50 and is always tensioned toward the other end of the toner supply pipe 50 by a spring 53.

Figure 7:
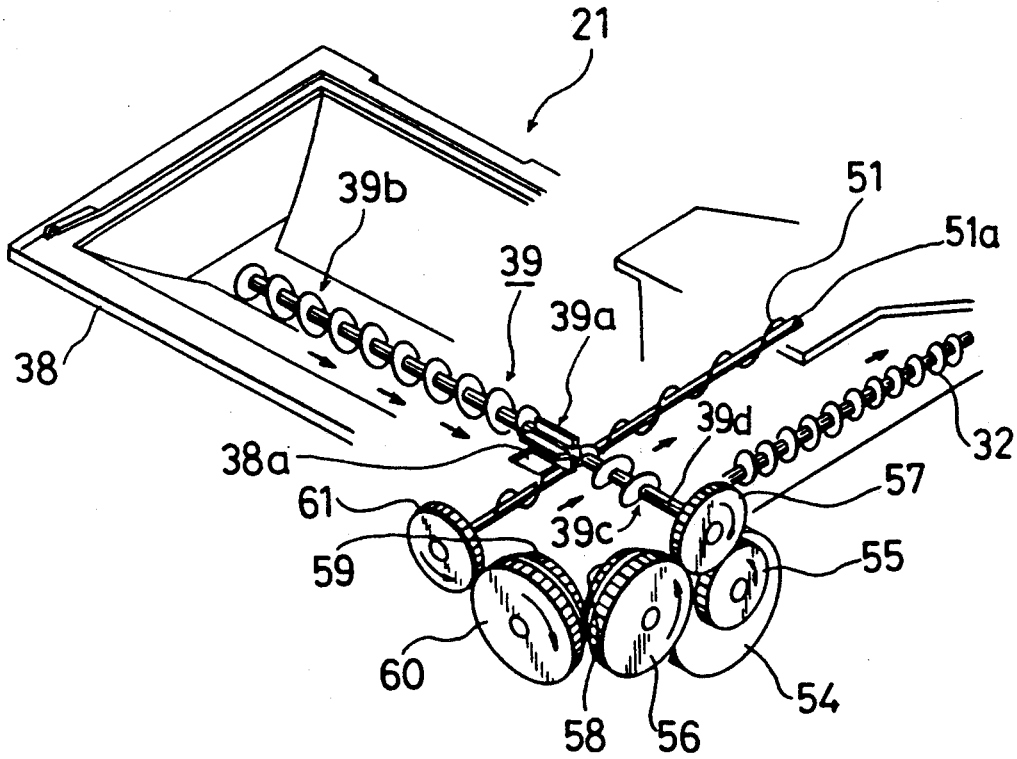

Referring to FIGS. 3, 5 and 7: a drive gear 55 is connected to a drive motor 54 in the right (in FIG. 3) end part of the hopper 21. The drive gear 55 is connected to the rod 39*d* of the transfer member 39 through a first link gear 56 and a gear 57 for toner supply. As shown in FIG. 3, the first link gear 56 is connected to a first bevel gear 58, and the bevel gear 58 is connected to a small gear 61 via a second bevel gear 59 and a second link gear 60 integrally formed thereon. The small gear 61 is fixed to the rod 51*a* extending outward from the hopper 21, accordingly thereby, the drive gear 55 drives the spiral 51.

Toner Cartridge

Figure 11:
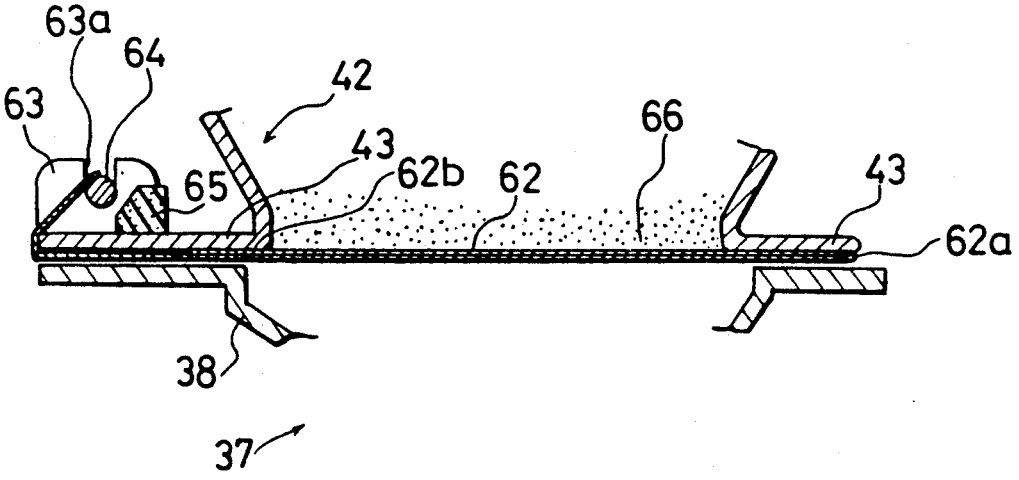
FIG. 11 is a sectional view showing a rolling mechanism for rolling up a seal member.

The toner cartridge 42 is for storing toner and supplying the toner to the toner container 38. Referring to FIGS. 5 and 11: the toner cartridge 42 consists of a cartridge body 42*a*, a seal member 62 and a rolling-up mechanism.

The cartridge body 42*a* is box-shaped and has an opening 66 at the bottom end. There are sloping walls in the lower part of the cartridge body 42*a* whereof the lower ends are closer to each other than the upper ends. The flange 43 is formed at the bottom end, as described above, and is slid into the holders 40 and 41 of the hopper body 37 when the cartridge 42 is to be attached to or detached from the hopper body 37. As shown in FIG. 5, there is a hole 43*a* for locking, into which a locking projection 38*b* of the toner container 38 is engaged to fix the toner cartridge 42, when the cartridge body 42*a* is set onto the hopper body 37.

Referring to FIG. 11: the cartridge 42 has the opening 66 closed by the folded seal member 62 before use. On the flange 43, there is a mechanism with which the seal member 62 is rolled up, when the cartridge body 42*a* is set onto the hopper body 37. The mechanism consists of a supporter 63, a roller 64 and a pressing member 65. The supporter 63 is formed integrally on the operator-side part of the flange 43.

The supporter 63 has a U-shaped notch 63*a* into which the roller 64 is received rotatably. The folded seal member 62 is adhered to the roller 64 at the free end. The roller 64 has a crank-shaped end portion 64*a* for handling, referred to as a roll-up handle. The pressing member 65, made of resin having a sponge-like elasticity, extends in the lengthwise direction of the seal member 62 along the roller 64. The pressing member 65 presses on the outer surface of the seal member 62 when it is rolled by the roller 64.

Setting for Use

When the developing unit 10 is set in the machine body 1, as shown in FIG. 5, the hopper 21 is fixed to the developing device 20 and then the front cover 19 is closed. Thus, the end portion of the toner supply pipe 50 is inserted into the connecting opening 20*a* of the developing device 20, because the inside surface of the front cover 19 pushes the rod 51*a* toward the right (in FIG. 5). The end of the cover 52 on the toner supply pipe 50 touches the edge of the opening 20*a* of the developing device 20, and thereupon the cover 52 is moved backward in relation to the toner supply pipe 50, pressing the spring 53, to open the lower opening 50*b* of the toner supply pipe 50.

Toner Supply

The transporting route of toner is shown in FIG. 7. The spiral 32 of the developing device 20 is continually rotated by a driving system, not shown. However, the transfer means 39 and the spiral 51 of the hopper 21 are usually stopped.

When a toner supply instruction is outputted in a copying process due to toner consumption, the drive motor 54 starts and the drive gear 55 of the hopper 21 rotates. The rotation of the drive gear 55 is transferred to the transfer means 39 through the first link gear 56 and the toner supply gear 57. As the transfer means 39 rotates, one portion of toner in the left side (in FIG. 3) is transported by the spiral part 39*b*, and another portion in the right side (in FIG. 3) is transported by the spiral part 39*c* to the rotor 39*a*, respectively. The rotor 39*a* permits a constant amount of toner to go down through the toner supply opening 38*a*, by means of the wings 45.

In addition to the rotation of the transfer means 39, the rotation of the first link gear 56 is transferred to the small gear 61 through the bevel gears 58 and 59 and the second link gear 60. Accordingly, the rod 51*a* connecting with the small gear 61 rotates to cause the spiral 51 to rotate. As a result, toner dropped from the supply opening 38*a* is transported in the toner supply pipe 50 to the right (in FIG. 5). The toner transported by the spiral 51 is supplied to the supply part 20*c* of the developing device 20 through the lower opening 50*b* of the toner supply pipe 50.

The toner supplied to the toner supply part 20*c* of the developing device 20 is transported in the longitudinal direction of the supply part 20*c* by the spiral 32. Since a slot 20*b* extends in the longitudinal direction below the spiral 32, the toner is supplied through the slot 20*b* to the agitation roller 31 and the scooping rotor 30. Then, when the concentration of toner reaches a predetermined level, the toner supply instruction stops, and the drive motor 54 of the hopper 21 stops, thereby halting the toner supply operation.

In the toner supply operation as described in the above, since the toner supply opening 38*a* is located not at the end, but in the middle of the hopper 21, the transportation distance of toner in the toner container 38 is thereby short. Therefore, the residence time of toner located at the lateral ends of the container 38 in the beginning is reduced, so that less amount of toner can adhere to the inner surfaces of the container 38.

The rotor 39*a* of the transfer means 39 permits only the predetermined amount of toner to fall through the opening 38*a*, and this rotor 39*a* closes the opening 38*a* with its wings 45 when the rotor 39*a* stops. Therefore, the toner cannot be over-supplied, and thereby neither an excessive-toner problem nor a spreading-toner problem can occur.

Toner Movement

In the above toner supply operation, the rod 39*d* rotates to rotate the spiral part 39*b*. Since the spiral part 39*b* contacts the bottom ends of the side swing plates 46 towards each of its ends, the bottom ends of the swing plates 46 are alternately pushed up by the spiral and not pushed while the spiral 39*b* is rotating. As a result, the bottom parts of the side swing plates 46 pivot on the upper part. Furthermore, the rear swing plate 48 also swings by the oscillation of the side swing plates 46, since both side ends of the rear swing plate 48 are on the side swing plates 46.

The front swing plate 47 also swings similarly to the above, since the projection 47*a* of the front swing plate 47 is on one of the wings 45, and the bottom end of the front swing plate 47 is pushed up by the wings 45, and not contrariwise, due to the rotation of the rotor 39*a*.

Thus, the swing plates 46–48 swing against the four slopes in the toner container 38 when the toner is supplied, so that the toner in the toner container 38 can move down to the bottom, thereby not remaining on the slopes.

Exchanging Developing Device

Figure 12:
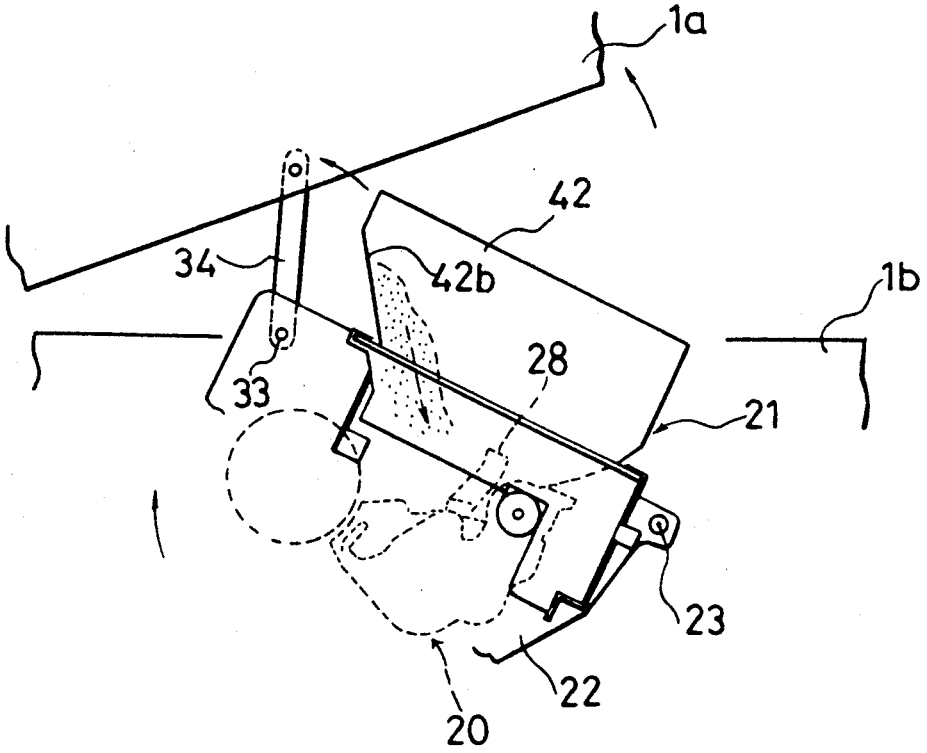
FIG. 12 is a view showing a developing unit which is being exchanged.

The operation will be described as when the developing device 20 is exchanged to change developing colors. The hopper 21 usually contains toner of a particular color, such as black, which is the most frequently used. When the developing color is changed to red, for example, the lock between the upper portion 1*a* and the lower portion 1*b* of the machine body 1 in FIG. 1 is opened, and the upper portion 1*a* is rotated in the counterclockwise direction about the hinge 18 to open the body 1. Opening the upper portion 1*a* pulls up the link member 34, so that the front plate 22 and the rear plate, connected to the link members 34 with the pins 33, rotate clockwise about the fulcra 23. The situation herewith is shown in FIG. 12. Under the condition of FIG. 12, the developing device 20 is able to come out upward from the machine body.

Then, the rod 51*a* of the hopper 21 is pulled toward the operator, so that the rod 51*a*, the spiral 51 and the toner supply pipe 50 move to the left (in FIG. 5, as shown with phantom lines). As a result, the right end portion of the toner supply pipe 50 comes out from the opening 20*a* of the developing device 20 so that the hopper 21 and the developing device 20 are disconnected. Subsequently, the developing device 20 is pulled up by grasping the handle 28, so that the support members 26 and 27 come out from the pockets P1 and P2 of the side plates, and the developing device 20 slides up along the guides 24 and 25 to the outside of the machine body 1.

Next, a red developing device 20 which contains red toner, for example, is inserted into the machine body 1, and the support members 26 and 27 are made to go down along the guides 24 and 25 of the plate 22. Thereby, the support members 26 and 27 are supported by the pockets P1 and P2. Since the surface of the guide 25 supporting the support member 26 is a part of the arc of radius R whereof the center coincides with that of the photoconductive drum 8, the distance between the developing roller 29 and the photoconductive drum 8 is maintained strictly at the predetermined value, even if the position of the supported member 26 is different from the predetermined position in the vertical direction.

After the developing device 20 is supported by the pockets P1 and P2, a rod 51*a* of the hopper 21 is pushed by the operator. However, the developing device 20 containing red toner does not have the connecting opening 20*a* and the spiral 32 which are provided in the black developing device. Therefore, there is no portion which pushes back the cover 52, so that the lower opening 50*b* of the toner supply pipe 50 is still covered by the cover 52 due to the pressure of the spring 53, even if the toner supply pipe 50 of the hopper 21 is pushed. Furthermore, in this case, a detector such as a switch (not shown) detects the inserted developing device 20, which is not the black developing device 20, so that the motor for supplying toner is not activated.

When the former black developing device 20 is reinserted, the black developing device 20 is supported by the pockets P1 and P2 through an operation similar to the above operation. The rod 51*a* is then pushed by the operator, so that the end of the toner supply pipe 50 is inserted into the opening 20*a* of the developing device 20. Even if the operator does not push the rod 51*a*, the front cover 19 pushes the rod 51*a* with its inner surface when the cover 19 is closed, thereby the end of the toner supply pipe 50 automatically moves into the opening 20*a* of the developing device 20.

In the above exchange operation of the developing devices 20, the surface of the photoconductive drum 8 is not damaged, because the developing devices 20 can slide downwards to be installed and upwards to be withdrawn, guided by the guides 24 and 25. Furthermore, since only the developing devices 20, a part of the developing unit, are exchanged when the developing color is changed, the operation is facilitated. This developing unit can be also used when a great number of copies in a particular color must be made, because the most frequently used color toner can be stored in the toner cartridge 42 of the hopper 21.

Since the toner supply pipe 50 is inserted in the developing device 20 by the movement of the front cover 19 of the machine body 1, the hopper 21 and the developing device 20 are automatically connected after the developing devices 20 are exchanged. In addition, since the lower opening 50*b* of the toner supply pipe 50 is automatically covered by the cover 52 when the developing device 20 of a color instead of the particular color (black in the above embodiment) is used, the particular-color toner does not leak out from the hopper body 37.

Furthermore, in the above developing unit, the toner cartridge 42 tilts as shown in FIG. 12 when the developing devices 20 are exchanged, so that any portion of the toner remaining on the sloping part 42*b* of the toner cartridge 42 drops to the bottom of the container. This means that all the toner can drop smoothly, even wherein a toner cartridge 42 that has been expanded laterally to increase its volume is used.

Installing Toner Cartridge

Before a new toner cartridge 42 can be installed in the developing unit, an empty toner cartridge 42 must be drawn out in the horizontal direction, therein pressing down the projection 38*b*, and then thrown away. Subsequently, the new toner cartridge 42 is slid in the horizontal direction, with its flange 43 inserted into the holders 40 and 41 of the toner container 38. As a result, the projection 38*b* is engaged with the hole 43*a*, formed in the flange 43, to lock the new toner cartridge 42.

Figure 13A:
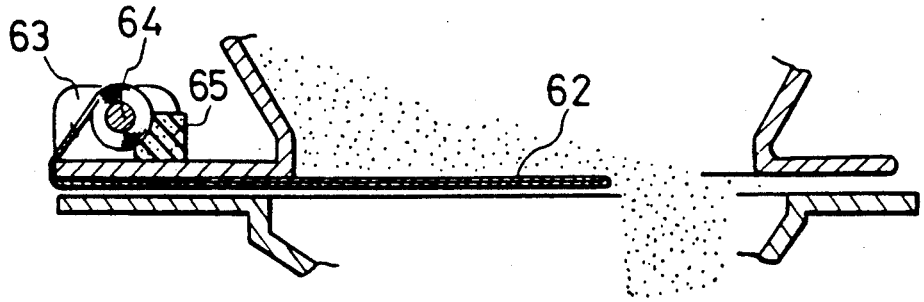
FIGS. 13A–13C are views for explaining the function of the mechanism of rolling up the seal member.
Figure 13B:
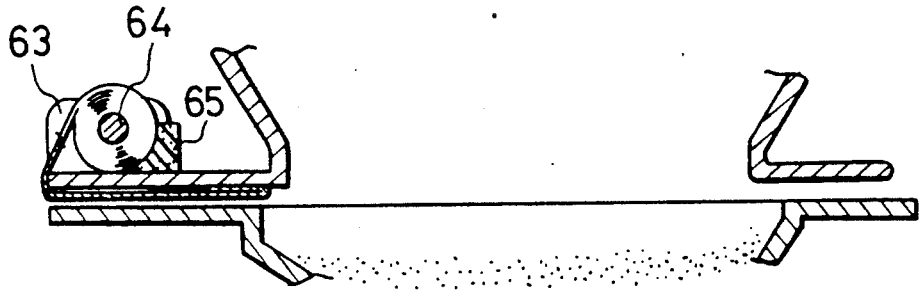
Figure 13C:
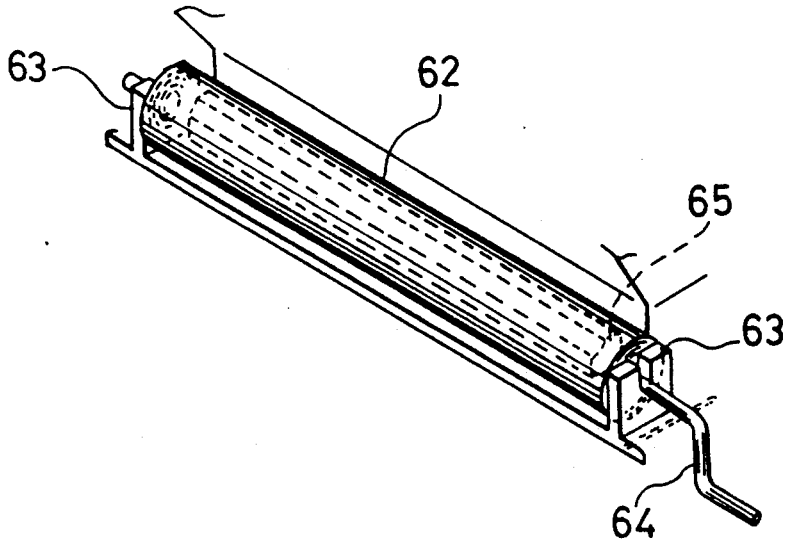

Next, the roller 64 is rotated clockwise (in FIG. 11) in order to roll up the folded seal member 62 as shown in FIGS. 13A and 13B. As the seal member 62 is rolled up by the roller 64, its outer surface is pressed by the pressing member 65, as shown in FIG. 13C.

Since the rolled-up seal member 62 is pressed by the pressing member 65, expansion of the diameter of the rolled seal member 62 due to its elasticity does not occur. Furthermore, the pressing member 65 can clean the seal member 62 of toner adsorbed on its surface, as the seal member 62 is rolled up. Therefore, the rolling-up mechanism in this embodiment does not require any one-way mechanism to fix the direction of rolling, whereas a conventional rolling mechanism needs a one-way mechanism to ensure that the surface of the seal member with toner is always placed inside. Moreover, since the pressing member 65 keeps the rolled seal member 62 from expanding, as described above, the variety of the material which may constitute the seal member 62 is less limited; thereby the degree of freedom of its material is increased.

MODIFICATIONS (a) In the above embodiments, the rotor 39*a* of the transportation member 39 has four wings 45. However, the rotor 39*a* may be a sponge roller to close the toner supply opening 38*a*.

(b) A structure for swinging the front swing plate 47 is not limited by the description of the above embodiment in which the front swing plate 47 has the projection 47*a* extending into the wings 45 of the rotor 39*a*.

Figure 14:
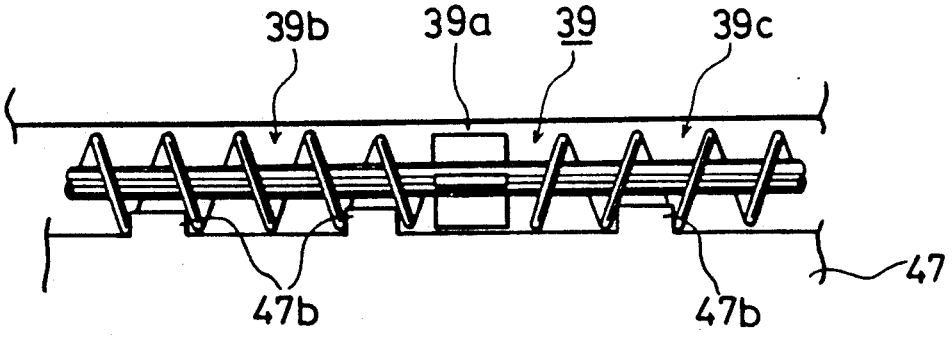
FIG. 14 is a plan view showing a part of a modified container.

For example, as shown in FIG. 14, the front swing plate 47 may have a plurality of projections 47*b* which engage with the spiral 39*b*. In this embodiment, the front swing plate 47 swings vertically and laterally to cause the toner to drop.

(c) The structure of the swing plates 46, 47 and 48 shown in the above embodiments can be modified. For example, inflexible plates having a smooth surface to facilitate toner glide can be used as the swing plates 46, 47 and 48. The upper end of the plates can be affixed to the container 38 so as to permit their oscillation by the movement of the spiral.

(d) The above embodiments may be applied not only to a toner supply apparatus for use in a copying machine but also to other kinds of apparatuses which are for supplying powder.

(e) A copying machine to which the present invention is applied is not limited to the clamshell type, in which a copying machine body 1 consists of the upper portion 1*a* and a lower portion 1*b* for opening, although the present invention is applied to the clamshell type in the above embodiments. For example, the present invention may be applied to a copying machine having a slidable contact glass. In this type of copying machine, after the contact glass is slid out from its position over the machine body to make an opening in the upper portion, the developing units can be exchanged through the opening.

(f) The present invention can be applied to other types of image forming apparatuses, such as a printer and a facsimile, although the developing unit according to the present invention is applied to a copying machine in the above embodiments.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An apparatus for supplying powder comprising:

a container having sloping inner walls, for containing powder;

a transportation member rotatably placed in a bottom portion of said container, for transporting said powder in a predetermined direction, said transportation member having a plurality of wings; and a swing plate located on one of said inner walls near a space in which said wings move upward by the rotation of said transportation member, said swing plate having an upper end connected to one of said sloping inner walls of said container and a bottom end having a projection positioned in the locus of said transportation member, said projection touching at least one end of said wings during rotation of said transportation member, wherein there is contact between the bottom end of the swing plate and the transportation member, such that said swing plate is swung by the rotation of said transportation member.

2. An apparatus for supplying powder according to claim 1, wherein said container has a supply opening at the bottom to allow said powder to drop; and said wings close said supply opening and allow, by their rotation, said powder to fall through said supply opening.

3. An apparatus according to claim 1, wherein said powder is toner supplied to a developing unit for developing a latent image on a photoconductor.

4. An apparatus for supplying powder comprising:

a container having sloping inner walls, for containing powder;

a transportation member rotatably placed in a bottom portion of said container, for transporting said powder in a predetermined direction;

a first swing plate located on one of said inner walls extending in a direction crossing the direction of the powder transportation of said transportation member, said first swing plate having an upper end connected to said wall and a bottom end positioned in the locus of said transportation member, wherein there is contact between the bottom end of the first swing plate and the transportation member, such that said first swing plate is swung by the rotation of said transportation member; and an auxiliary, second swing plate placed on one of the inner walls extending along the direction of powder transportation and stacked on said first swing plate at a corner of said inner walls, said auxiliary, second swing plate being activated by said first swing plate.

5. An apparatus according to claim 4, wherein said transportation member has a spiral.

6. An apparatus according to claim 4, wherein said container has a supply opening at the bottom to allow the powder to drop; and said transportation member has a plurality of wings to cover said supply opening and to allow, by its rotation, said powder to fall through said supply opening.

7. An apparatus for supplying powder comprising:

a container containing powder and having a supply opening in part of a bottom thereof to allow powder to drop;

a rotation member including wings;

a rotatable transportation member for transporting said powder from said container to said supply opening, said transportation member including a pair of spirals coiling in opposite directions on either side of said wings, wherein said transportation member is coaxial with said rotation member;

said rotation member for covering said supply opening and allowing, by its rotation, said powder to fall through said supply opening; and a lower transporting means below said container for transporting said powder dropped from said supply opening, wherein said lower transporting means includes:

a casing extending in a direction crossing a direction in which said transportation member extends in said container;

a powder supply pipe slidable inserted in said casing and having an upper opening for communicating with said powder supply opening at one end portion and a lower opening at the other end portion; and a spiral, disposed rotatably in said powder supply pipe, for transporting said powder dropped from said container to said lower opening.

8. An apparatus for supplying powder comprising:

a container containing powder and having a powder receiving opening in part of a top portion and a powder supply opening in part of a bottom portion to allow powder to drop;

a transportation member for transporting said powder from said container to said supply opening;

a rotation member for covering said supply opening which rotates together with said transportation member, said rotation member including a plurality of wings; and a lower transportation means below said container for transporting said powder dropped from said supply opening; said lower transportation means including: a casing extending in a direction crossing a direction in which said transportation member extends in said container; a powder supply pipe slidably inserted in said casing and having an upper opening for communicating with said supply opening at one end portion and a lower opening at the other end portion; and a spiral disposed rotatably in said powder supply pipe, for transporting said powder dropped from said container to said lower opening.

9. An apparatus according to claim 8, wherein said transportation member is coaxial with said rotation member.

10. An apparatus according to claim 9, wherein said transportation member includes a pair of spirals coiling in opposite directions on either side of said rotation member.

11. An apparatus according to claim 10, wherein said powder is toner which is supplied to a developing unit for developing a latent image on a photoconductor.

* * * * *